US011745372B1

(12) United States Patent
Truyenque et al.

(10) Patent No.: US 11,745,372 B1
(45) Date of Patent: Sep. 5, 2023

(54) BLADE ASSEMBLY FOR A GLOVE

(71) Applicants: Percy Robert Truyenque, Long Beach, CA (US); Paul David Relf, Long Beach, CA (US)

(72) Inventors: Percy Robert Truyenque, Long Beach, CA (US); Paul David Relf, Long Beach, CA (US)

( * ) Notice: Subject to any disclaimer, the term of this patent is extended or adjusted under 35 U.S.C. 154(b) by 285 days.

(21) Appl. No.: 17/087,314

(22) Filed: Nov. 2, 2020

(51) Int. Cl.

| | |
|---|---|
| ***B26B 1/02*** | (2006.01) |
| ***B26B 27/00*** | (2006.01) |
| ***A41D 19/00*** | (2006.01) |
| ***B26B 21/40*** | (2006.01) |

(52) U.S. Cl.
CPC ..... *B26B 27/005* (2013.01); *A41D 19/0024* (2013.01); *B26B 21/4075* (2013.01); *B26B 27/007* (2013.01)

(58) Field of Classification Search
CPC . B26B 27/005; B26B 27/007; B26B 21/4075; A41D 19/0024
See application file for complete search history.

(56) References Cited

U.S. PATENT DOCUMENTS

| | | | | |
|---|---|---|---|---|
| 5,325,596 | A * | 7/1994 | Baker | B26B 27/007 30/304 |
| 10,575,574 | B1 * | 3/2020 | Toledo | B67B 7/0411 |
| 2007/0028452 | A1 * | 2/2007 | LaFauci | B65B 69/0033 30/142 |
| 2010/0236077 | A1 * | 9/2010 | Shirey | B26B 1/02 2/160 |
| 2012/0180324 | A1 * | 7/2012 | Caldwell | B26B 27/007 30/298 |
| 2013/0019367 | A1 * | 1/2013 | Lasci | A41D 19/0024 2/160 |
| 2014/0259694 | A1 * | 9/2014 | Oldham | B26B 27/007 30/298 |
| 2015/0328791 | A1 * | 11/2015 | Jones | B26B 3/08 30/162 |
| 2019/0184588 | A1 * | 6/2019 | Keelan | B26B 27/005 |
| 2021/0138672 | A1 * | 5/2021 | Scimone | B26B 27/007 |

* cited by examiner

*Primary Examiner* — Omar Flores Sanchez

(57) ABSTRACT

A blade assembly, configured safely and efficiently pierce and shear an item. The blade assembly has a bottom member, configured to be joined to an underside of a glove finger with an adhesive. The bottom member further comprises a flat top portion. A block is joined the flat top portion and further comprising a raised portion. A blade is joined to the raised portion. A top member is joined to the bottom member and further comprising a flat portion with an opening. The opening surrounds the blade.

3 Claims, 3 Drawing Sheets

BLADE ASSEMBLY FOR A GLOVE

BACKGROUND

The embodiments herein relate generally to clothing and specific accessories to perform a physical unpackaging function at all retailers.

Gloves are worn to protect the user from allergic contact dermatitis caused by the usage of adhesive resins used in the manufacture of cardboard. In particular, humans react to P-Tertiary-butylphenol formaldehyde resin (PTBP). Many people have an allergic reaction to this resin and, within 48-72 hours, eczema can occur. Recent events concerning the advent of the Corona Virus Covid-19 Pandemic has affected many people employed in stocking shelves or handling containers. However, the use of gloves does not make the utilization of box cutters or knives (required to open sealed boxes and shrink-wrapped goods) easy to operate. The hands must be free to open lids or peel open the surrounding packaging and the knife must be retracted, sheathed or placed down before continuing with auxiliary tasks.

Knives, box cutters are sharp and dangerous tools that cause many injuries, spilt or wasted goods and are inefficient because they need to be stowed away between uses.

Prior to embodiments of the disclosed invention there was not a glove that could easily cut without injuring a user. Embodiments of the disclosed invention solve this problem.

SUMMARY

A blade assembly is configured to safely and efficiently pierce and shear an item. A bottom member is joined to an underside of a glove finger with an adhesive and encapsulates the piercing blade form. The top encapsulation portion has a flat top to aid in orientating the pierce/shear blade to be perpendicular to the material being sheared and the guideline across the top of the chosen finger helps with the intended shearing direction. The top and bottom molded halves that encase the pierce/shearing, soft edged blade are contoured to the shape of the underside of the finger and the profile is kept as low as possible to obtain maximum control and avoid any lateral deflection when pushing down onto the object to be opened.

It is not even necessary to complete the entire shearing process across the entire container. Once the splitting or shearing is initiated the tape will continue to shear apart by leveraging the taped sides apart in a normal opening process. The whole process can be executed very quickly and there is no risk to the user or the contents within the package.

The blade assembly is so safe to use that business owners should seek reduction in workman's compensation costs and realize an unprecedented safe working environment with fewer lost days due to injuries.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
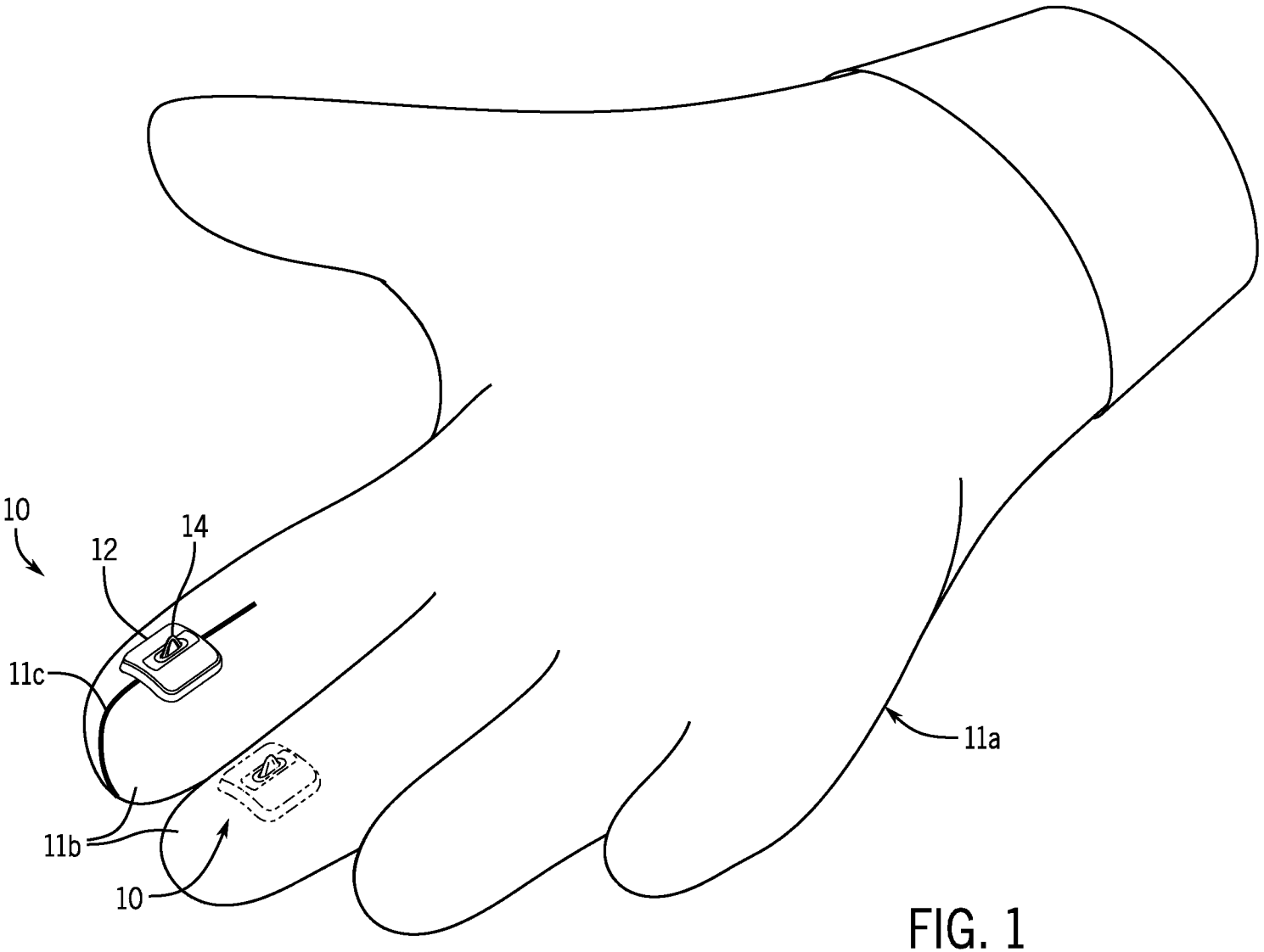
FIG. 1 shows a perspective view of one embodiment of the present invention shown in use.
Figure 2:
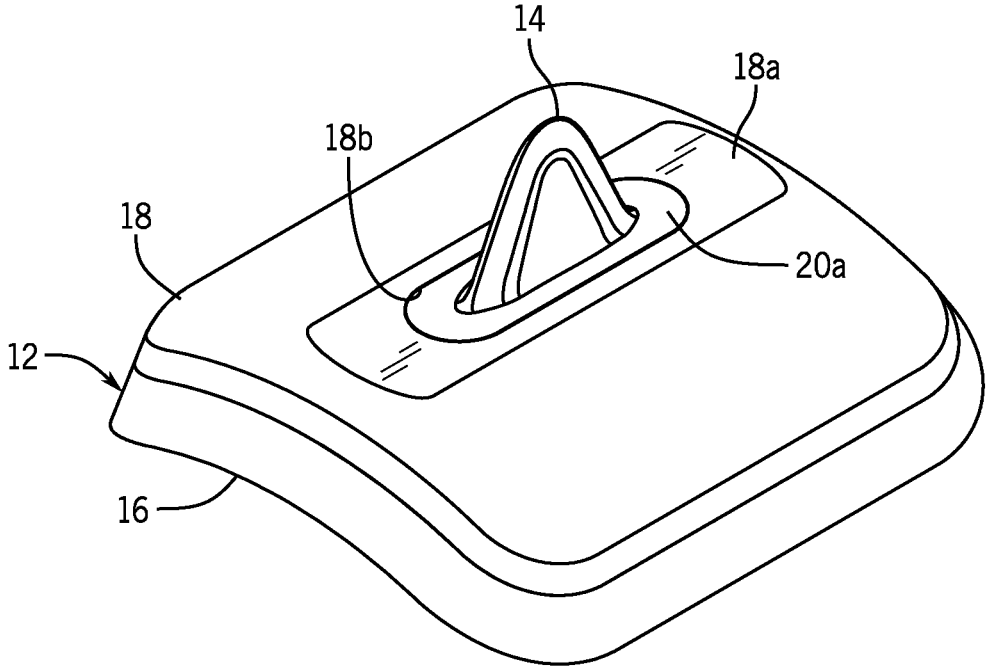
FIG. 2 shows a detail view of one embodiment of the present invention.
Figure 3:
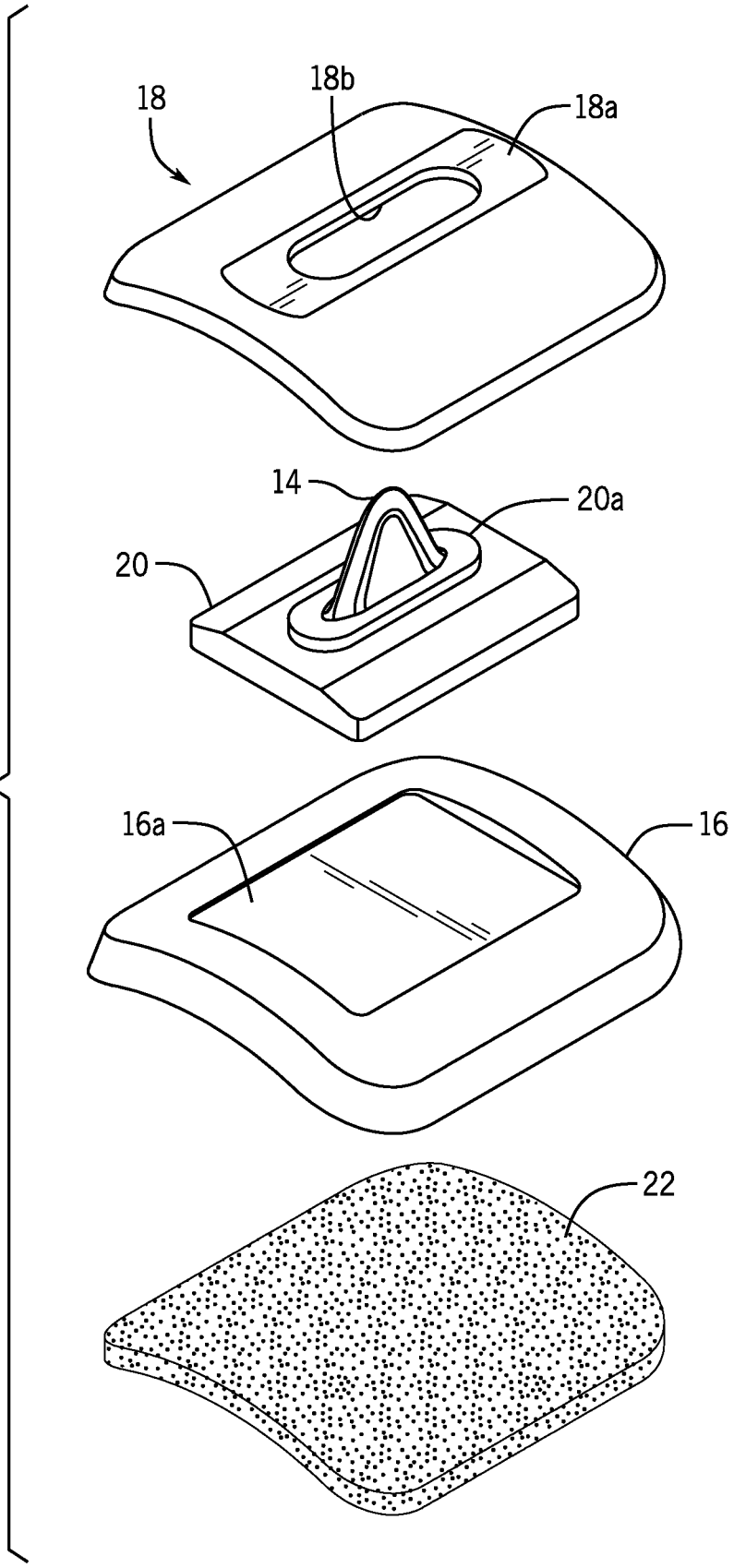
FIG. 3 shows an assembly view of one embodiment of the present invention.

By way of example, and referring to FIGS. 1-3, one embodiment of a glove assembly 10 is configured to safely and efficiently open a sealed item. The item can be any type of packaging tape or shrink type plastic wrap.

The glove assembly 10 has a glove 11*a* further comprising a palm back and palm front joined to a thumb, first finger 11*b*, a second finger 11*b*, a third finger and a fourth finger. A guideline 11*c* is arranged centrally on the top side of the first or index finger 11*b*.

A blade assembly is joined to the first finger 11*b* on top of at least some of the guideline 11*c*. The blade assembly further comprises a bottom member 16, which is joined to the top side of the first finger 11*b* with an adhesive. The bottom member 16 further comprises a flat top portion 16*a*.

A block 20 is joined the flat top portion 16*a* and further comprises a raised portion 20*a*. A blade 14 is joined to the raised portion 20*a*. The blade 14 is rounded, is made from aluminum, and extends 5-6 mm from the raised portion 20*a* to prevent loss of control of the glove assembly 10 when cutting.

A top member 18 is joined to the bottom member 16 and further comprises a flat portion 18*a* with an opening 18*b*. The bottom member 16 can be made from plastic. The top member 18 can be made from plastic, and the top member 18 can be glued to the bottom member. This reduces vibration of the blade 14 when the blade 14 is used for cutting. The opening 18*b* surrounds the blade 14.

Embodiments of the glove assembly have many benefits over using a traditional glove and knife. The rounded blade is safe and will not cut a user. The blade assembly is always available which is efficient. The rounded blade prevents damaging goods within packaging. The use of the glove assembly prevents eczema and contact dermatitis from resins associated with cardboard and plastics. The glove assembly can be fitted to right-handed or left-handed persons or people that use their forefinger for writing can apply the opener to the index finger instead especially if the glove is fitted with a heat censored writing surface on the forefinger for use with tablets and forms of electronic devices used in inventorying the stored product. The blade assembly can be attached to any make, shape, style or preference of glove.

In some embodiments, strategically placed units over the palm and fingers of a butchers glove would aid in the ability to hold the produce firmly while cutting the desired areas of meat, poultry or fish without damaging the produce.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶ 6. In particular, any use of "step of" in the claims is not intended to invoke the provision of 35 U.S.C. §112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A blade assembly, configured safely and efficiently pierce and shear an item; the blade assembly comprising:

a bottom member, configured to be joined to an underside of a glove finger; wherein the bottom member further comprises a flat top portion;

a block, joined the flat top portion and further comprising a raised portion;

a blade, joined to the raised portion;

a top member, joined to the bottom member and further comprising a flat portion with an opening; wherein the opening surrounds the blade; wherein the bottom member is made from plastic, the top member is made from plastic, and the top member is glued to the bottom member.

2. The blade assembly of claim 1, wherein the blade is rounded and made from one member of a material set consisting of a metal, ceramic and carbide; wherein the blade and extends 5-6 mm from the raised portion to ensure stability in use while not piercing contents of the item.

3. The blade assembly of claim 2, wherein the top member and the bottom member have a very low profile to reduce the drag on the glove and vibration is reduced to ensure the shearing is clean and quick.

* * * * *